US006237912B1

(12) United States Patent
Motooka et al.

(10) Patent No.: US 6,237,912 B1
(45) Date of Patent: May 29, 2001

(54) SIGNATURE SLOW-DOWN UNIT OF FOLDING MACHINE

(75) Inventors: Mikio Motooka; Isamu Mitamura, both of Mihara (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/257,749

(22) Filed: Feb. 25, 1999

(30) Foreign Application Priority Data

Feb. 27, 1998 (JP) ..... 10-046750
Sep. 14, 1998 (JP) ..... 10-259910

(51) Int. Cl.[7] ..... B65H 5/02; B65H 5/34; B65H 29/66

(52) U.S. Cl. ..... 271/273; 271/270; 271/202; 271/182

(58) Field of Search ..... 271/202, 182, 271/229, 246, 266, 270, 273, 274, 203

(56) References Cited

U.S. PATENT DOCUMENTS

| | | | | |
|---|---|---|---|---|
| 3,994,221 | * | 11/1976 | Littleton | 101/227 |
| 4,269,402 | * | 5/1981 | Fischer et al. | 493/437 |
| 4,461,467 | * | 7/1984 | Herb | 271/202 |
| 4,516,759 | * | 5/1985 | Kobler | 270/12 |
| 4,913,415 | * | 4/1990 | Weber | 271/272 |
| 5,014,975 | * | 5/1991 | Hamricke | 271/202 |
| 5,102,111 | | 4/1992 | Reponty . | |
| 5,161,793 | * | 11/1992 | Lotto et al. | 271/182 |
| 5,386,984 | * | 2/1995 | Del Toso et al. | 271/122 |
| 5,417,416 | | 5/1995 | Marmin et al. . | |
| 5,536,001 | * | 7/1996 | Lange et al. | 271/202 |
| 6,019,714 | * | 2/2000 | Stab | 493/429 |
| 6,149,151 | * | 11/2000 | Blanchard et al. | 271/270 |

FOREIGN PATENT DOCUMENTS

| | | |
|---|---|---|
| 33 21 811 C2 | 1/1986 | (DE) . |
| 36 26 287 C3 | 4/1997 | (DE) . |
| 498 068 A1 | 12/1991 | (EP) . |

* cited by examiner

*Primary Examiner*—Donald P. Walsh
*Assistant Examiner*—Daniel K Schlak
(74) *Attorney, Agent, or Firm*—Alston & Bird LLP

(57) ABSTRACT

A signature conveying apparatus is disclosed which is structured simply and which enables a stable high-speed operation to be performed when a chopper-folding operation is performed by conveying the signatures to a chopper-folding unit at a low speed. A signature conveying unit of a folding machine incorporates a delivery cylinder which is rotated at a speed lower than the peripheral speed of a gripping cylinder and a speed-reduction cylinder. A high-speed conveying means conveys signatures received from the delivery cylinder and the speed-reduction cylinder at the same peripheral speed as that of the delivery cylinder and the speed-reduction cylinder. A speed-change conveying means receives the signatures conveyed from the high-speed conveying means to convey the signatures to a low-speed conveying means such that the conveyance speed is gradually reduced. The speed-change conveying means is provide with a plurality of pairs of upper and lower speed-change drive rollers disposed apart from one another for a distance shorter than the length of the signature. The low-speed conveying means conveys the signatures to chopper-folding units at a low speed.

20 Claims, 10 Drawing Sheets

SIGNATURE SLOW-DOWN UNIT OF FOLDING MACHINE

BACKGROUND OF THE INVENTION AND RELATED ART STATEMENT

1. Field of the Invention

The present invention relates to a signature-conveying apparatus of a folding machine of a rotary press.

2. Description of Related Art

Conventional commercial rotary presses, such as the one shown in FIGS. 11 and 12, includes a folding machine which has a chopper-folding unit.

A folding machine of a type having the above mentioned chopper-folding unit causes continuous paper W printed in a printing portion of a rotary press to be introduced into a parallel folding portion 1 which incorporates a serration cylinder 2, a folding cylinder 3 and a gripping cylinder 4. The continuous paper W is cut into sheets each having a predetermined size at a position between the serration cylinder 2 and the folding cylinder 3. Then, the sheet is, between the folding cylinder 3 and the gripping cylinder 4, folded in parallel with the cutting line so that the size of the sheet is halved. Thus, signatures S1 are formed.

As shown in FIG. 11, the signatures S1 are held between an upper conveying belt 7*a* and a lower conveying belt 7*b* arranged to move at the same peripheral speed of each cylinder disposed in the parallel folding portion 1. Thus, the signatures S1 are conveyed toward a chopper-folding unit 9. The signature S1 moved by the upper and lower conveying belts 7*a* and 7*b* is brought into contact with a stopper 15 of the chopper-folding unit 9 so as to be stopped. In synchronization with the stoppage timing, a chopper blade is pressed against the central portion of the signature S1 so that a signature S2 folded half in a direction perpendicular to the cutting line of the signature S1 is formed.

A folding machine structured as shown in FIG. 12 is employed by a rotary press of a type which usually processes printed matter which is chopper-folded. As shown in FIG. 12, the foregoing folding machine incorporates a speed-reduction cylinder 5 disposed between a parallel folding portion 1 and chopper-folding units 9A and 9B and arranged to be rotated at a peripheral speed lower than that of each cylinder disposed in the parallel folding portion 1. Moreover, the folding machine shown in FIG. 12 incorporates a delivery cylinder 6 which is in contact with the speed-reduction cylinder 5 and arranged to be rotated at the same peripheral speed as that of the speed-reduction cylinder.

The cylinders 5 and 6 are connected to corresponding chopper-folding units 9A and 9B which are two units disposed vertically. The signature S1 discharged from the gripping cylinder 4 is delivered from the gripping cylinder 4 to the speed-reduction cylinder 5 along the surfaces of the two cylinders 4 and 5. The signatures S1 are alternately delivered to a passage formed from the speed-reduction cylinder 5 to the lower chopper-folding unit 9A and another passage formed from the speed-reduction cylinder 5 to the upper chopper-folding unit 9B through the delivery cylinder 6.

The signature S1 allowed to pass through the lower conveying belts 7*a* and 7*b* and the delivery cylinder 6 and alternately placed on the upper conveying belts 8*a* and 8*b* are held between the conveying belts 7*a* and 7*b* and the conveying belts 8*a* and 8*b* so as to be conveyed. Then, the is leading end of the signature S1 is brought into contact with each stopper 15 of the chopper-folding units 9A and 9B. At this time, the chopper blade is pressed against the central portion of the signature S1 so that a signature S2 folded into two perpendicular to the cutting line of the signature S1 is formed.

In the folding machine incorporating the speed-reduction cylinder 5, the two chopper-folding units 9A and 9B are alternately operated as described above. The speed, at which the signature S1 is conveyed to the chopper-folding units 9A and 9B, can be reduced. As a result, even if the printing speed of the rotary press is raised, repulsion, which is produced when the signature S1 is brought into contact with the stopper 15 of each of the chopper-folding units 9A and 9B, can be reduced. Therefore, the folding accuracy can be stabilized and, thus, the chopper-folding operation can be performed at high speed.

OBJECT AND SUMMARY OF THE INVENTION

The conventional folding machines incorporating the chopper-folding units have the following problems.

The usual folding machine structured as shown in FIG. 11 is not provided with the speed-reduction cylinder. In this case, the signature S1 discharged from the gripping cylinder 4 is held between the upper and lower conveying 7*a* and 7*b* which are moved at the same speed as that of each cylinder disposed in the parallel folding portion so as to be conveyed. Therefore, if the speed of the rotary press is raised, repulsion is intensified excessively which is produced when the signature S1 is brought into contact with the stopper 15 of the chopper-folding unit. Thus, the signature S1 is rebounded, causing the folding accuracy to deteriorate. What is worse, the paper is torn and/or wrinkles occur in the folding line portion. Therefore, when the chopper-folding operation is performed, the speed of the rotary press must be reduced, that is, a low-speed operation is required.

The folding machine structured as shown in FIG. 12 and provided with the speed-reduction cylinder 5 is arranged to alternately use the two chopper-folding units 9A and 9B. Therefore, the speed at which the signature S1 is conveyed to the chopper-folding units can be reduced. As a result, repulsion which is produced when the signature S1 is brought into contact with the stopper 15 of the chopper-folding unit can be reduced. As a result, the chopper-folding operation can be performed at high speed.

As described above, the gripping mechanism delivers, along the surfaces of the cylinders, the signature S1 from the gripping cylinder 4, which is rotated at the high peripheral speed, to the speed-reduction cylinder 5 which is rotated at the low peripheral speed. Therefore, the gripping mechanism must have a claw unit of the speed-reduction cylinder 5 which corresponds to the opening/closing operation of the gripping plate of the gripping cylinder 4. Therefore, a complicated mechanism is required. To raise the operating speed, disorder of the signature S1 occurring when the delivery is performed must be prevented and time required for the gripping mechanism to be opened/closed must be shortened. The foregoing requirements are considerably difficult to be achieved. Therefore, the operation speed of the rotary press cannot furthermore be raised.

An object of the present invention is to provide a signature-conveying apparatus which is capable of overcoming the above mentioned problems and conveying signatures to a chopper-folding unit with a simple structure so that a high-speed chopper-folding operation is performed.

To achieve the above mentioned object, according to one aspect of the present invention, there is provided a signature-conveying apparatus for a folding machine structured to convey signatures formed in a parallel folding portion of the folding machine having a speed-reduction portion incorporating a speed-reduction cylinder and/or a delivery cylinder which is rotated slower than the peripheral speed of a gripping cylinder and discharged from the speed-reduction portion, the signature-conveying unit for a folding machine comprising: high-speed conveying means for conveying signatures received from the speed-reduction portion at the same peripheral speed as that of the speed-reduction portion; low-speed conveying means for conveying the signatures at a low speed; and speed-change conveying means incorporating a plurality of speed-change drive rollers for receiving the signatures conveyed from the high-speed conveying means and forcibly changing the speed so as to deliver the signatures to the low-speed conveying means such that the speed is gradually reduced, wherein each of end portions of inlet and outlet portions of the speed-change conveying means has a portion overlapping the corresponding conveying means to be connected.

To achieve the above mentioned object, according to a second aspect of the present invention, there is provided a signature-conveying apparatus for a folding machine structured to convey signatures formed in a parallel folding portion of the folding machine having a speed-reduction portion incorporating a speed-reduction cylinder and/or a delivery cylinder which is rotated slower than the peripheral speed of a gripping cylinder and discharged from the speed-reduction portion, the signature-conveying unit for a folding machine comprising: high-speed conveying means for conveying signatures received from the speed-reduction portion at the same peripheral speed as that of the speed-reduction portion; low-speed conveying means for conveying the signatures at a low speed; and speed-change conveying means incorporating a plurality of speed-change drive rollers and a rotative pressing roller for receiving the signatures conveyed from the high-speed conveying means and forcibly changing the speed so as to deliver the signatures to the low-speed conveying means such that the speed is gradually reduced, wherein each of end portions of inlet and outlet portions of the speed-change conveying means has a portion overlapping the corresponding conveying means to be connected.

To achieve the above mentioned object, according to a third aspect of the present invention, there is provided a signature-conveying apparatus for a folding machine for conveying signatures formed in a parallel folding portion of the folding machine and discharged from a gripping cylinder, the signature-conveying apparatus for a folding machine comprising: two sorting means for alternately sorting passages for signatures conveyed along the outer surface of the gripping cylinder; two high-speed conveying means for receiving signatures sorted by the sorting means to convey the signatures at the same peripheral speed as that of the gripping cylinder; two low-speed conveying means for conveying the signatures at a low speed; and two speed-change conveying means incorporating a plurality of speed change drive rollers for receiving the signatures conveyed from the high-speed conveying means and forcibly changing the speed so as to deliver the signatures to the low-speed conveying means such that the speed is gradually reduced, wherein each of end portions of inlet and outlet portions of the speed-change conveying means has a portion overlapping the corresponding conveying means to be connected.

To achieve the above mentioned object, according to a fourth aspect of the present invention, there is provided a signature-conveying apparatus for a folding machine for conveying signatures formed in a parallel folding portion of the folding machine and discharged from a gripping cylinder, the signature-conveying apparatus for a folding machine comprising: two sorting means for alternately sorting passages for signatures conveyed along the outer surface of the gripping cylinder; two high-speed conveying means for receiving signatures sorted by the sorting means to convey the signatures at the same peripheral speed as that of the gripping cylinder; two low-speed conveying means for conveying the signatures at a low speed; and two speed-change conveying means incorporating a plurality of speed-change drive rollers and a rotative pressing roller for receiving the signatures conveyed from the high-speed conveying means and forcibly changing the speed so as to deliver the signatures to the low-speed conveying means such that the speed is gradually reduced, wherein each of end portions of inlet and outlet portions of the speed-change conveying means has a portion overlapping the corresponding conveying means to be connected.

To achieve the above mentioned object, according to a fifth aspect of the present invention, there is provided a signature-conveying apparatus for a folding machine for conveying signatures formed in a parallel folding portion of the folding machine and discharged from a gripping cylinder, the signature-conveying apparatus for a folding machine comprising: one high-speed conveying means for receiving signatures discharged from the gripping cylinder to convey the signatures at the same peripheral speed as that of the gripping cylinder; two low-speed conveying means for conveying the signatures at a low speed; and one speed-change conveying means incorporating a plurality of speed-change drive rollers for receiving the signatures conveyed from the high-speed conveying means and forcibly changing the speed so as to deliver the signatures to the low-speed conveying means such that the speed is gradually reduced, wherein sorting means for alternately sorting the signatures to the two low-speed conveying means is disposed at an end of the speed-change conveying means.

To achieve the above mentioned object, according to a sixth aspect of the present invention, there is provided a signature-conveying apparatus for a folding machine for conveying signatures formed in a parallel folding portion of the folding machine and discharged from a gripping cylinder, the signature-conveying apparatus for a folding machine comprising: one high-speed conveying means for receiving signatures discharged from the gripping cylinder to convey the signatures at the same peripheral speed as that of the gripping cylinder; two low-speed conveying means for conveying the signatures at a low speed; and one speed-change conveying means incorporating a plurality of speed-change drive rollers and a rotative pressing roller for receiving the signatures conveyed from the high-speed conveying means and forcibly changing the speed so as to deliver the signatures to the low-speed conveying means such that the speed is gradually reduced, wherein sorting means for alternately sorting the signatures to the two low-speed conveying means is disposed at an end of the speed-change conveying means.

DETAILED DESCRIPTION OF PREFERRED EMBODIMENTS

Figure 1:
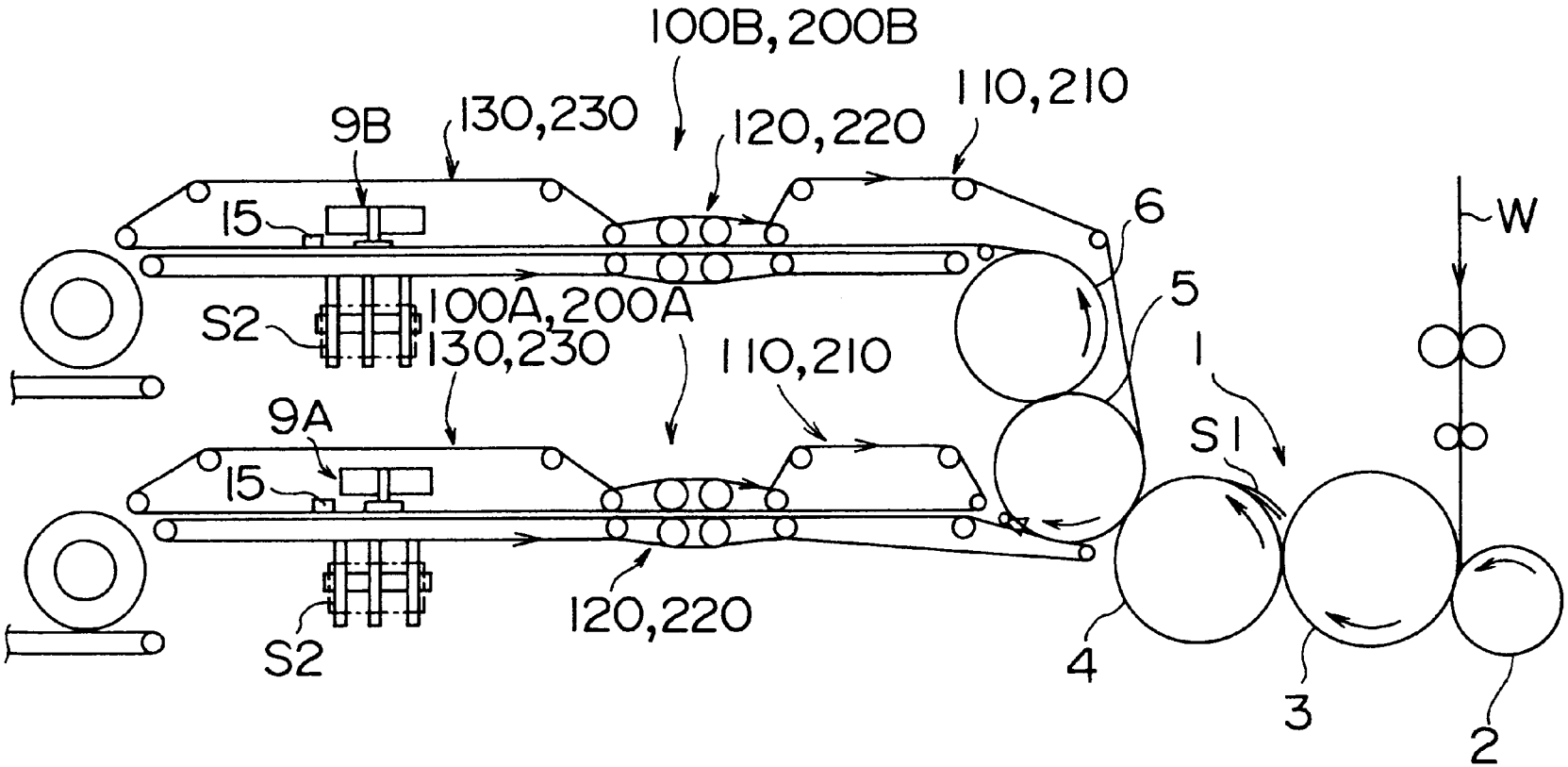
FIG. 1 is a diagram showing the schematic layout in a folding machine according to a first embodiment of the present invention.

A first embodiment of a signature-conveying apparatus for a folding machine according to the present invention will now be described with reference to the drawings.

Referring to FIGS. 1 to 5, symbol W represents a continuous paper fed into the folding machine and numeral 1 represents a known parallel folding portion incorporating a serration cylinder 2, a folding cylinder 3 and a gripping cylinder 4. Symbol S1 represents a signature cut at a position between the serration cylinder 2 and the folding cylinder 3 to have a predetermined size, and then folded at a position between the folding cylinder 3 and gripping cylinder 4 into two which is in parallel with a cutting line. Reference numeral 5 represents a speed-reduction cylinder 5 which is in contact with the gripping cylinder 4 of the parallel folding portion 1. The speed-reduction cylinder 5 is rotated at a speed lower than the peripheral speed of the gripping cylinder 4 so as to receive the signature S1 from the speed-reduction cylinder 5. Reference numeral 6 represents a delivery cylinder disposed in contact with the speed-reduction cylinder 5 and arranged to be rotated at the same peripheral speed as that of the speed-reduction cylinder 5 so as to receive the signature S1 from the speed-reduction cylinder 5. Reference numeral 100A represents a lower signature-conveying unit disposed downstream of the speed-reduction cylinder 5 so as to receive the signature S1 discharged from the speed-reduction cylinder 5 and convey the signature S1. Reference numeral 100B represents an upper signature-conveying unit disposed downstream of the delivery cylinder 6 so as to receive the signature S1 discharged from the delivery cylinder 6 so as to convey the signature S1. Reference numerals 9A and 9B represent chopper-folding units for chopper-folding the signature S1 conveyed by the signature conveying units 100A and 100B. Symbol S2 represents a signature folded into two perpendicular to the cutting line of the signature S1 by the chopper-folding units 9A and 9B.

As shown in FIG. 1, the folding machine is provided with a known parallel folding portion 1 for receiving a continuous paper W printed in a printing portion (not shown). The parallel folding portion 1 incorporates the serration cylinder 2, the folding cylinder 3 and the gripping cylinder 4. The serration cylinder 2 and the folding cylinder 3 are structured to cut the continuous paper W at the position between the serration cylinder 2 and the folding cylinder 3. Thus, the continuous paper W is cut into cut sheets each having a predetermined size. The folding cylinder 3 and the gripping cylinder 4 fold the cut continuous paper W into two in parallel with the cutting line. Hereinafter the sheet obtained by folding the continuous paper W into two is called a signature S1.

The speed-reduction cylinder 5 is in contact with the gripping cylinder 4 of the parallel folding portion 1. The speed-reduction cylinder 5 receives the signature S1 from the gripping cylinder 4 while the speed-reduction cylinder 5 is being rotated at a speed lower than the peripheral speed of the gripping cylinder 4. The lower signature-conveying unit 100A is disposed downstream of the speed-reduction cylinder 5 so as to receive the signature S1 discharged from the speed-reduction cylinder 5.

The delivery cylinder 6 is in contact with the speed-reduction cylinder 5. The delivery cylinder 6 receives the signature S1 from the speed-reduction cylinder 5 while the delivery cylinder 6 is being rotated at the same peripheral speed as that of the speed-reduction cylinder 5. The upper signature-conveying unit 100B is disposed downstream of the delivery cylinder 6 so as to receive the signature S1 discharged from the delivery cylinder 6.

The signature conveying units 100A and 100B will now be described.

The signature conveying units 100A and 100B according to the present invention are applied to the folding machine of a commercial offset rotary press structured as described above.

As shown in FIG. 1, the signature conveying units 100A and 100B incorporate a high-speed conveying means 110, a speed-change conveying means 120 and a low-speed conveying means 130. The high-speed conveying means 110 disposed upstream receives the signature S1 delivered from the speed-reduction cylinder 5 and the delivery cylinder 6 so as to convey the signature S1 at the same peripheral speed as that of the speed-reduction cylinder 5 and the delivery cylinder 6. Then, the high-speed conveying means 110 delivers the signature S1 to the speed-change conveying means 120 disposed downstream.

The speed-change conveying means 120 receives the signature S1 conveyed from the high-speed conveying means 110. The conveying speed of the speed-change conveying means 120 is gradually reduced to deliver the signature S1 to the low-speed conveying means 130. The low-speed conveying means 130 conveys the signature S1 to the chopper-folding units 9A and 9B at a low speed.

Moreover, swinging mechanisms arranged to vertically swing in synchronization with receipt and delivery of the signature S1 are disposed across the speed-change conveying means 120.

Figure 2:
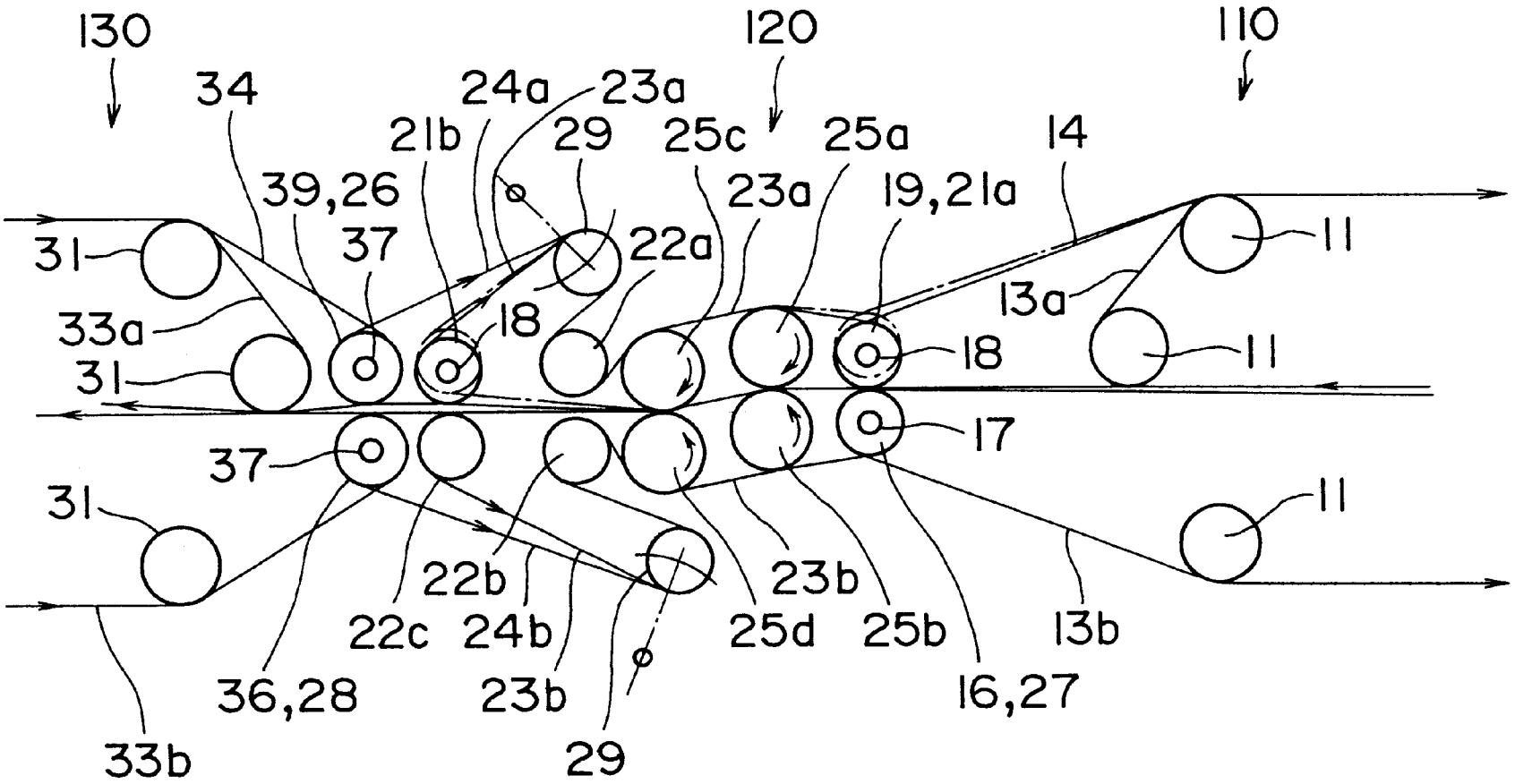
FIG. 2 is a diagram showing the layout in a signature conveying apparatus according to the first embodiment of the present invention.
Figure 3:
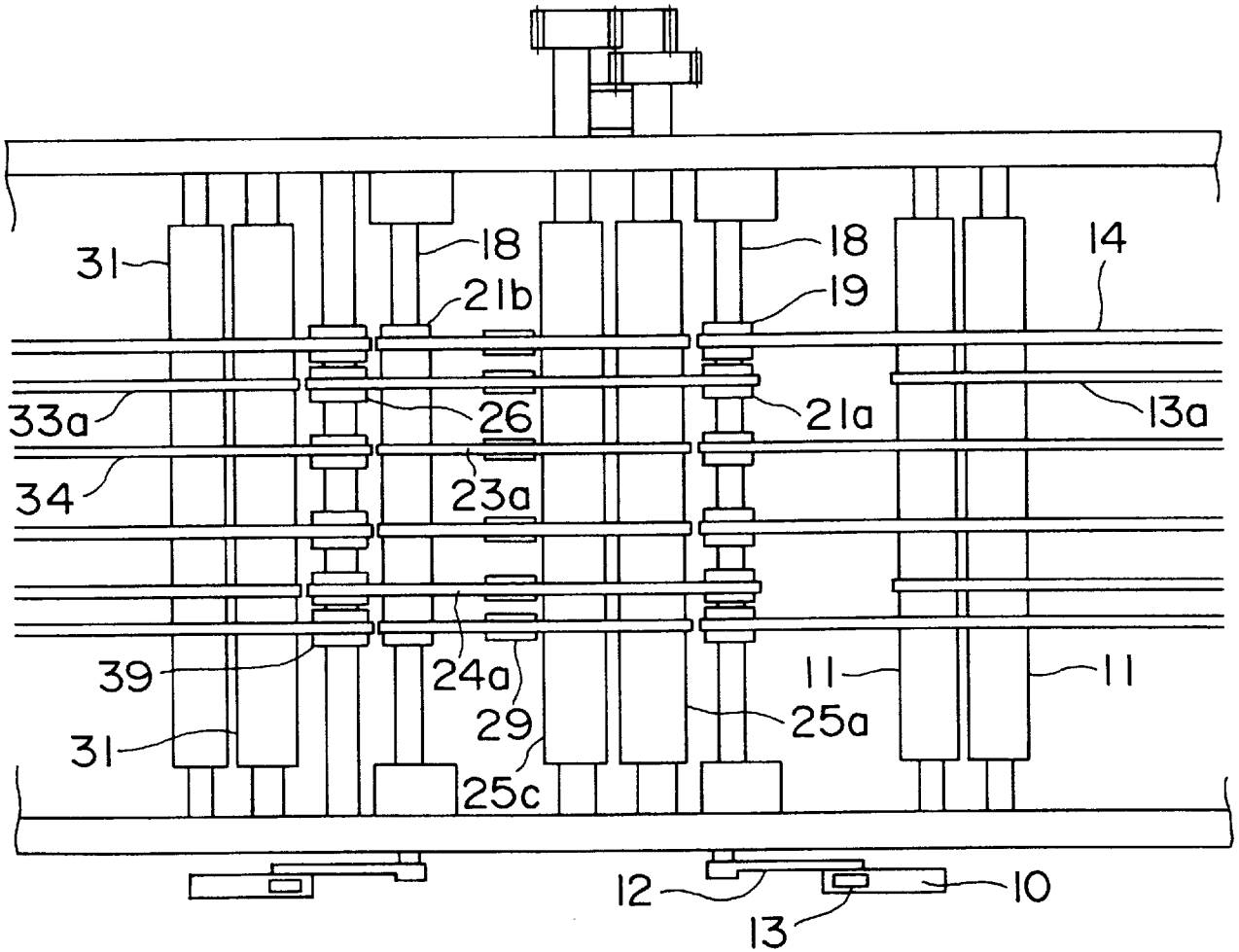
FIG. 3 is a plan view of FIG. 2.

As shown in FIGS. 2 and 3, the high-speed conveying means 110 incorporates upper conveying belts 13*a* and 14 and a lower conveying belt 13*b*. Moreover, the high-speed conveying means 110 incorporates a plurality of rotative belt rollers 11, 16, 19, . . . , around which the foregoing conveying belts are arranged. The high-speed conveying means 110 is mechanically rotated to hold each signature S1 delivered from the speed-reduction cylinder 5 and the delivery cylinder 6 and rotated the same peripheral speed as that of the outer surface of the speed-reduction cylinder 5. Each of the belt rollers 19 and 16 disposed vertically to be in contact with each other incorporates a plurality of small-width rollers rotatively supported by the swingable shaft 18 and the common shaft 17 which are common shafts for the high-speed conveying means 110 and the speed-change conveying means 120.

The speed-change conveying means 120 incorporates rollers which are rotated vertically in opposite directions by a cam mechanism (not shown) structured to gradually reduce the peripheral speed of the speed-reduction cylinder 5 and the gripping cylinder 4 to a considerably reduced speed. The speed-change conveying means 120 incorporates two sets of speed-change driver rollers, which are a set of speed-change drive rollers 25*a* and 25*b* and another set of speed-change drive rollers 25*c* and 25*d*. The set of the speed-change drive rollers 25*a* and 25*b* and the other set of the speed-change drive rollers 25*c* and 25*d* are disposed apart from each other for a distance shorter than the length of the signature S1.

The plurality of the upper conveying belts 23*a* and 24*a* and lower conveying belts 23*b* and 24*b* are rotated by the speed-change drive rollers so as to hold and convey the signature S1 delivered from the high-speed conveying means 110 such that the conveying speed is considerably and gradually reduced as compared with the peripheral speed of the gripping cylinder 4.

The speed-change conveying means 120 incorporates a plurality of rotative belt rollers 21*a*, 21*b*, 22*a* to 22*c* and 26 to 28 and a belt straining pulley around which the foregoing conveying belts are arranged. The belt rollers 21*a* and 21*b* are provided for the corresponding swingable shafts 18, while the belt rollers 27 and 28 are provided for the common shafts 17 and 37. The foregoing belt rollers are a plurality of small-width rollers supported rotatively.

Each of the belt roller 21*a* disposed upstream of the speed-change drive roller 25*a* and the belt roller 21*b* disposed downstream of the speed-change drive roller 25*c* has the swingable shaft which is vertically swung through a swinging mechanism in synchronization with introduction timing or discharging timing of the signature S1. Since the swinging mechanism is a known technique, the mechanism is omitted from description.

Figure 4:
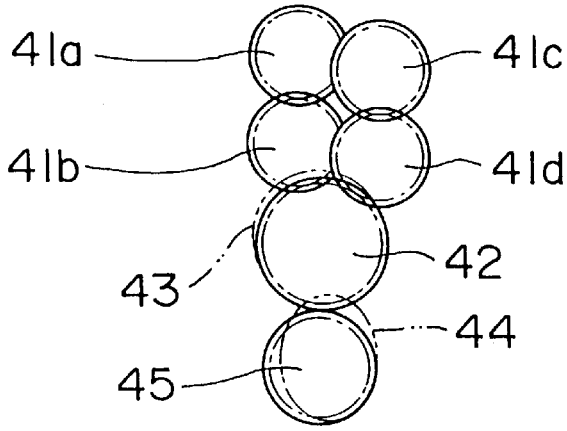
FIG. 4 is an enlarged front view of a gear portion of the speed-change conveying means shown in FIG. 2.
Figure 5:
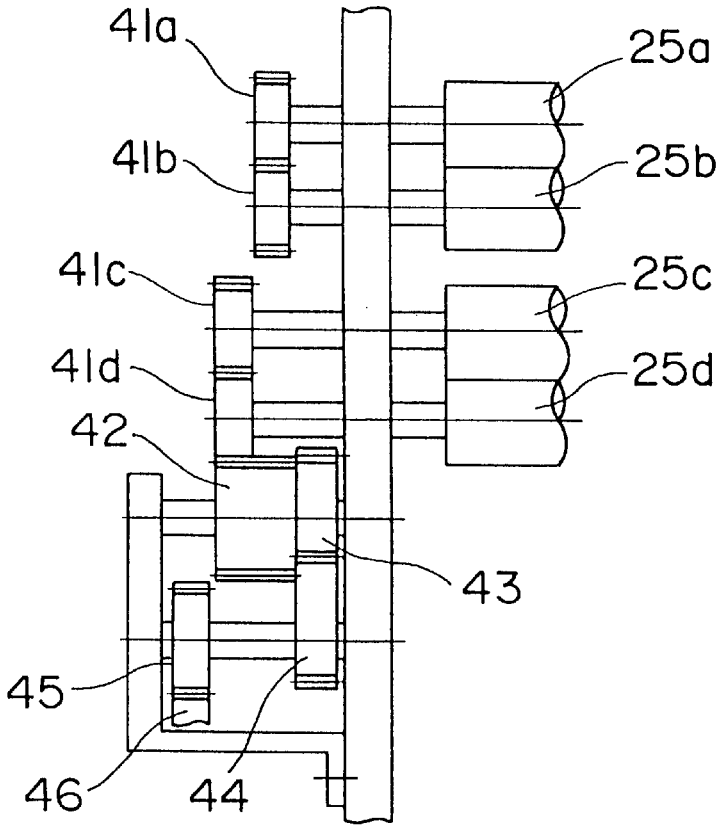
FIG. 5 is an enlarged side view showing the gear portion of the speed-change conveying means shown in FIG. 2.

As shown in FIGS. 4 and 5, the speed-change drive rollers 25*a* to 25*d* are, through gears 41*a* to 41*d* and 42, rotated by a cam mechanism structured to reduce the peripheral speed of the speed-reduction cylinder 5 to a speed at which the intervals of the signatures S1 are shortened to an extent which does not raise a problem for performing the chopper-folding operation. Moreover, the cam mechanism is structured to again restore (accelerate) the foregoing intervals. The accelerating and decelerating mechanism incorporates a gear 42, the rotational speed of which is changed by non-circular gears 44 and 43 which are rotated by a gear 45 engaged to a prime gear 46 connected to the power source of the main body of the folding machine. The gear 42 rotates gears 41*a* to 41*d* joined to a drive-side end of a shaft of each speed-change drive roller.

The low-speed conveying means 130 incorporates a plurality of upper conveying belts 33*a* and 34 and a lower conveying belts 33*b* arranged to mechanically be rotated. Moreover, the low-speed conveying means 130 incorporates a plurality of rotative belt rollers 31, 36, 39, . . . , around which the conveying belts are arranged. The belts 33*a*, 34 and 33*b* holds the signature S1 delivered from the speed-change conveying means 120 to convey the signature S1 to the chopper-folding unit at a peripheral speed which has considerably be reduced (to an extent which does not cause the distance from a next signature S1 to raise a problem for performing the chopper-folding operation). A plurality of rotative belt rollers 31, 36, 39, . . . , are used to arrange the foregoing conveying belts. The belt rollers 36 and 39 disposed vertically to be in contact with each other are a plurality of small-width rollers rotatively supported by the common belt 37 which is a common shaft for the speed-change conveying means 120 and the low-speed conveying means 130.

As shown in FIG. 1, the chopper-folding units 9A and 9B are disposed in the low-speed conveying means 130 so that the signatures S1 sequentially conveyed by the signature conveying units 100A and 100B are chopper-folded. Symbol S2 shown in FIG. 1 is a signature folded into two perpendicular to the cutting line of the signature S1 by the chopper-folding units 9A and 9B.

The operation of the first embodiment of the present invention will now be described.

When the operation of the rotary press has been started, the continuous paper W is cut to have a predetermined size at a position between the serration cylinder 2 and the folding cylinder 3 disposed in the parallel folding portion 1. Thus, a signature S1 is, between the folding cylinder 3 and the gripping cylinder 4, 2, formed which has a shape folded into two in parallel to the cutting line. Then, the fold-line portion of the signature S1 is gripped by a gripping unit of the gripping cylinder 4 so as to be conveyed along the outer surface of the gripping cylinder 4. The gripping cylinder 4 is furthermore rotated so that the signature S1 is released from the gripping unit. Then, the fold-line portion of the signature S1 is gripped by claws of the speed-reduction cylinder 5 which is being rotated at the peripheral speed lower than that of the gripping cylinder 4. Thus, the unit for gripping the signature S1 is changed from the gripping cylinder 4 to the speed-reduction cylinder 5. The signatures S1 received by the speed-reduction cylinder 5 are alternately delivered to the delivery cylinder 6 which is being rotated at the same peripheral speed as that of the speed-reduction cylinder 5.

Then, each of the signatures S1 alternately discharged from the speed-reduction cylinder 5 and the delivery cylinder 6 is held between the upper conveying belts 13*a* and 14 and the lower conveying belt 13*b* of the high-speed conveying means 110. Thus, the signature S1 is conveyed to the following speed-change conveying means 120 at the same peripheral speed as that of the speed-reduction cylinder 5. When the signature S1 conveyed by the upper and lower belts of the high-speed conveying means 110 reaches the inlet portion of the speed-change conveying means 120, the swingable shaft 18 for supporting the belt rollers 19 and 21*a* are swung upwards in synchronization with the movement to the inlet portion. Thus, the conveying belt 14 of the high-speed conveying means 110 and the upper conveying belt 23*a* of the speed-change conveying means 120 are caused to float. Thus, an unnecessary action for moving the signature S1 from the high-speed portion to the speed-change portion can be prevented. Therefore, the attitudes of the signatures are not disordered. Moreover, movement of the signatures S1 from the high-speed portion to the speed-change portion can smoothly be performed. When the belts 14 and 24*a* are allowed to float as described above, the signature S1 has reached the nip portion of the downstream conveying unit. Therefore, conveyance can reliably be performed and the signatures S1 are guided by the belts. Therefore, disorder of the signatures S1 can be prevented.

The signature S1 held by the upper conveying belts 23*a* and 24*a* and the lower conveying belts 23*b* and 24*b* of the speed-change conveying means 120 is allowed to pass through a position between the speed-change drive rollers 25*a* and 25*b* and the speed-change drive rollers 25*c* and 25*d*. Thus, the conveyance speed of the signature S1 is gradually reduced from the peripheral speed of the speed-reduction cylinder 5 to a speed considerably lower than the peripheral speed of the gripping cylinder 4. Thus, the signature S1 is conveyed to the low-speed conveying means 130 with a stable attitude.

When the signature S1 conveyed by the upper and lower conveying belts of the speed-change conveying means 120 reaches the outlet portion of the speed-change conveying means 120, the swingable shaft 18 of the belt roller 21*b* is upwards swung in synchronization with the movement to the outlet portion. Thus, the upper conveying belt 23*a* of the speed-change conveying means 120 is allowed to float so that the delivery of the signature S1 from the speed-change portion to the low-speed portion is smoothly performed.

The optimum timing for the belt rollers 19 and 21 on the swingable shafts 18 to be swung upwards so as to allow the belt rollers to float can be obtained by adjusting the phase of a cam 10 (see FIG. 3) for rotating the swingable shaft 18. The adjustment can easily be performed during an operation as well as during an adjustment operation.

The swinging mechanism is a mechanism having a cam follower 13 for following the cam 10 and a lever 12 to use eccentricity of the shaft so as to vertically move the belt rollers 19, 21*a* and 21*b*. The rotation may be realized by an air cylinder or the like.

The signature S1 held between the upper conveying belts 33*a* and 34 and the lower conveying belt 33*b* of low-speed conveying means 130 is moved to the chopper-folding units 9A and 9B at the speed considerably reduced from the peripheral speed of the gripping cylinder 4. The signature S1 moved to the chopper-folding units 9A and 9B by the upper and lower conveying belts is stopped because the leading end of the signature S1 is brought into contact with the stopper 15 of the chopper-folding unit. Then, the chopper blade is inwards pressed against the central portion of the stopped signature S1. Thus, a signature S2 folded into two perpendicular to the cutting line of the signature S1 is formed.

As described above, the folding machine according to this embodiment incorporates signature-conveying apparatus having the high-speed conveying means 110 for performing conveyance at the same peripheral speed as that of the speed-reduction cylinder 5; the low-speed conveying means 130 for conveying signatures S1 to the chopper-folding units 9A and 9B at the low speed; and the speed-change conveying means 120 for receiving the signatures S1 conveyed from the high-speed conveying means 110 to the low-speed conveying means 130 while the conveying speed is being gradually reduced. Therefore, the following effects can be obtained.

The conveyance speed of signatures S1 received from the gripping cylinder 4 is reduced by the speed-reduction cylinder 5 so as to alternately deliver the signatures S1 to the two chopper-folding units 9A and 9B. Therefore, the speed at which the signatures S1 are conveyed to the chopper folding unit can be reduced. Moreover, the conveyance speed is further reduced in the conveying passage. Therefore, repulsion which is produced when the signature S1 is brought into contact with the stopper 15 of the chopper-folding unit can significantly be reduced. As a result, the chopper-folding accuracy can furthermore be improved and stabilized even during a high-speed operation.

When the operation speed of the conventional rotary press is attempted to furthermore be raised, time required for each of the gripping plate of the gripping cylinder 4 and the claws of the speed-reduction cylinder 5 must furthermore be shortened. The reason for this lies in that the signature S1 is delivered from the gripping cylinder 4, which is rotated at a high peripheral speed, to the speed-reduction cylinder 5, which is rotated at a low peripheral speed. However, shortening of time is considerably difficult to be realized. Therefore, the operation speed of the rotary press cannot be raised. However, the folding machine according to the present invention incorporates the above mentioned signature conveying units. Therefore, the deceleration ratio of the speed-reduction cylinder 5 can somewhat be lowered to provide a spare for the time required for the gripping plate of the gripping cylinder 4 and the claws of the speed-reduction cylinder 5 to be opened/closed. Even in the above mentioned case, the conveying units according to the present invention enables the speed at which the signatures S1 are conveyed to the chopper-folding units to furthermore be reduced as compared with the speed realized by the conventional conveying units. Therefore, the operation speed of the rotary press can furthermore be raised.

The speed-change conveying means of the signature conveying unit according to the present invention incorporates two sets of speed-change drive rollers 25*a* and 25*b* and speed-change drive rollers 25*c* and 25*d* disposed vertically. The two sets of the speed-change drive rollers are disposed apart from each other for a distance shorter than the length of the signature S1. The signatures S1 conveyed from the high-speed conveying means are always applied with pressures from the two sets of the fore-and-aft speed-change drive rollers through the upper and lower conveying belt. Thus, the signatures S1 can be delivered to the low-speed conveying means such that the attitudes of the signatures S1 are always stabilized and the conveyance speed is gradually reduced. Moreover, the swinging mechanisms are disposed across the speed-change conveying means 120 to allow the leading end of the upper conveying belt 23*a* to float in accordance with the timing at which the signature S1 is received/delivered. Therefore, the attitudes of the signatures S1 are not disordered during the conveyance process. Therefore, a stable chopper-folding accuracy can be maintained.

Figure 6:
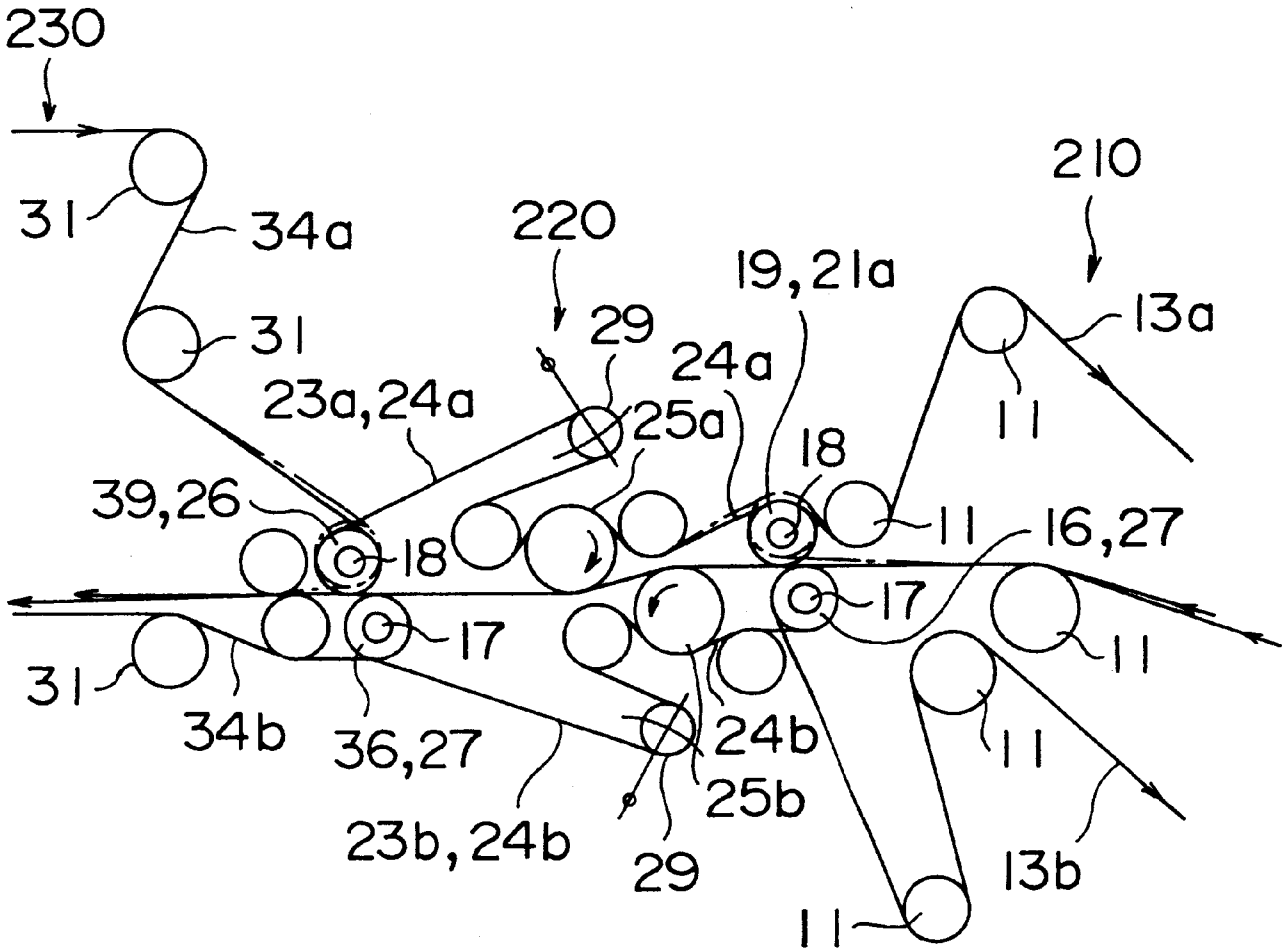
FIG. 6 is a diagram showing the layout in a signature conveying apparatus according to a second embodiment of the present invention.
Figure 7:
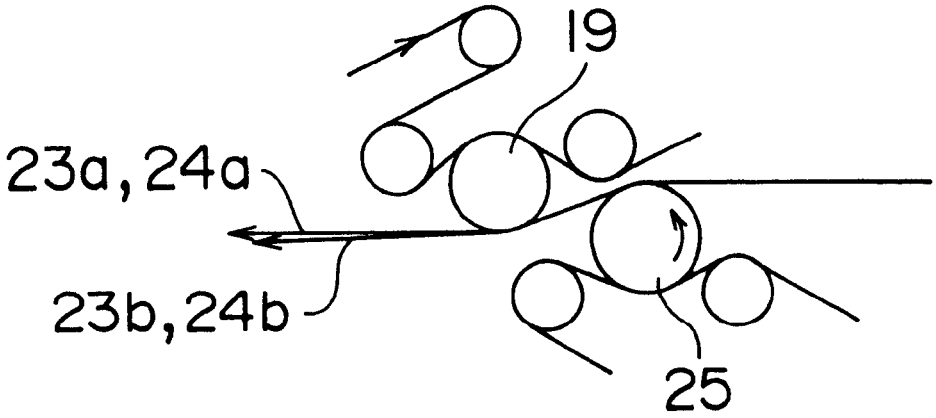
FIG. 7 is a diagram showing an application of the speed-change conveying means according to the second embodiment of the present invention.
Figure 8:
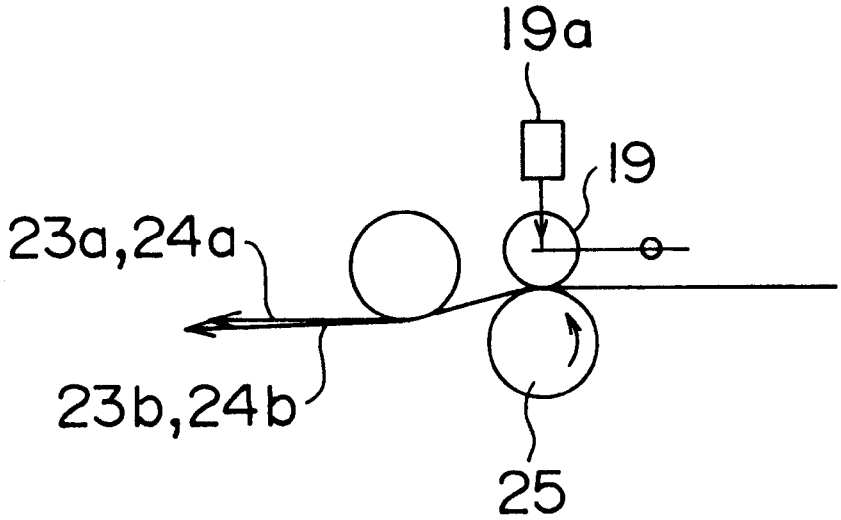
FIG. 8 is a diagram showing another application of the speed-change conveying means according to the second embodiment of the present invention.

A second embodiment of the present invention will now be described with reference to the drawings. The same elements as those shown in FIG. 1 will be described with reference to FIG. 1. FIG. 6 is a side view showing a signature-conveying apparatus according to the second embodiment. FIGS. 7 and 8 are diagrams showing an application of a speed-change conveying means.

Signature conveying units 200A and 200B according to this embodiment are applied to the folding machine of the commercial offset rotary press similar to that according to the first embodiment.

As shown in FIG. 1, the signature conveying units 200A and 200B, a high-speed conveying means 210 and a low-speed conveying means 230 have structures similar to those according to the first embodiment.

In the first embodiment, the two pairs of the upper and lower speed-change drive rollers constituting the speed-change conveying means are disposed apart from each other for a distance shorter than the length of the signature. On the other hand, a speed-change conveying means 220 according to this embodiment, as shown in FIG. 6, incorporates speed-change drive rollers 25*a* and 25*b* arranged to be rotated in opposite directions and disposed vertically apart from each other for a distance shorter than the length of the signature. A speed-change drive roller 25*a* for rotating the plurality of the upper conveying belts 23*a* and 24*a* has a circular-arc surface which presses the outer surfaces of the lower conveying belts 23*b* and 24*b* which are rotated by the speed-change drive roller 25*b*. The speed-change drive roller 25*b* has a circular-arc surface which presses the outer surface of the upper conveying belt 24*a*. Thus, great frictional force can be obtained between the upper and lower conveying belts.

The swinging mechanisms disposed across the speed-change conveying means 220, the accelerating/decelerating mechanisms for the speed-change drive rollers 25*a* and 25*b* and so forth are structured similarly to those according to the first embodiment.

When the operation of the rotary press has been started, the signatures S1 are alternately discharged from the speed-reduction cylinder 5 and the delivery cylinder 6. Then, the signatures S1 are, similarly to the first embodiment, held between the upper conveying belt 13*a* and the lower conveying belt 13*b* of the high-speed conveying means 210 connected to the speed-reduction cylinder 5 and the delivery cylinder 6, respectively. Thus, the signatures S1 are conveyed to the speed-change conveying means 220 at the same peripheral speed as that of the speed-reduction cylinder 5. When the signature S1 conveyed by the upper and lower conveying belts has reached an inlet portion of the speed-change conveying means 220, the swingable shaft 18 for supporting the belt rollers 19 and 21*a* is upwards swung in synchronization with the timing of the movement to the inlet portion. Thus, the upper conveying belt 13*a* of the high-speed conveying means and the upper conveying belt 24*a* of the speed-change conveying means 220 are allowed to float. Thus, an unnecessary action for moving the signature S1 from the high-speed portion to the speed-change portion can be prevented. Therefore, the attitudes of the signatures are not disordered. Moreover, movement of the signatures S1 from the high-speed portion to the speed-change portion can smoothly be performed.

The signature S1 held between the upper conveying belts 23*a* and 24*a* and the lower conveying belts 23*b* and 24*b* of the speed-change conveying means 220 is conveyed to the following low-speed conveying means 230. The conveyance is performed such that the conveyance speed is gradually reduced from the peripheral speed of the speed-reduction cylinder 5 to be considerably lower than the peripheral speed of the gripping cylinder 4. At this time, the speed-change drive roller 25*a* rotates the upper conveying belts 23*a* and 24*a*, while the speed-change drive roller 25 rotates the lower conveying belts 23*b* and 24*b*. In the foregoing state, the circular-arc surfaces of the speed-change drive roller 25*a* and the speed-change drive roller 25 press the outer surfaces of the corresponding conveying belts. Therefore, no slip occurs between the upper and lower conveying belts. Thus, the speed-change conveying means 220 is able to convey the signature S1 held between the upper and lower conveying belts to the low-speed conveying means 230 such that the conveyance speed is gradually reduced.

When the signature S1 conveyed by the upper and lower conveying belts of the speed-change conveying means 220 has reached the outlet portion of the speed-change conveying means 220, the swingable shafts 18 of the belt rollers 26 and 39 are upwards swung in synchronization with the timing of the movement to the outlet portion. Thus, the upper conveying belt 23*a* of the speed-change conveying means 220 and the upper conveying belt 34*a* of the low-speed conveying means 230 are allowed to float. As a result, the signature S1 can smoothly be delivered from the speed-change portion to the low-speed portion. The operations to be performed by the units following the low-speed conveying means, adjustment of the swinging timing and so forth are the same as those according to the first embodiment.

Therefore, the signature conveying unit according to this embodiment which incorporates only one speed-change drive roller provided for each of the upper and lower conveying belts enables the same effect obtainable from the first embodiment to be obtained. Moreover, the number of elements can be reduced as compared with the first embodiment. As a result, the structure can be simplified, causing maintenance and inspection of the machine to easily be performed.

The signature conveying unit according to this embodiment incorporates the speed-change conveying means 220 in which one speed-change drive roller is provided for each of the upper and lower conveying belts to rotate the conveying belt. Moreover the outer surfaces of the corresponding conveying belts are pressed by the circular-arc surfaces so that great frictional force is obtained by the upper and lower conveying belts. Note that the speed-change drive roller 25 may be provided for only either of the upper conveying belt or the lower conveying belt and a rotative pressing roller 19 may be provided for the other conveying belt, as shown in FIG. 7.

As shown in FIG. 8, a structure may be employed in which also the speed-change drive roller 25 is provided for either of the upper conveying belt or the lower conveying belt. Moreover, a rotative pressing roller 19 incorporating a pressing means 19*a*, such as an air cylinder, presses the upper and lower conveying belts disposed on the speed-change drive roller 25.

A third embodiment of the present invention will now be described.

Figure 9:
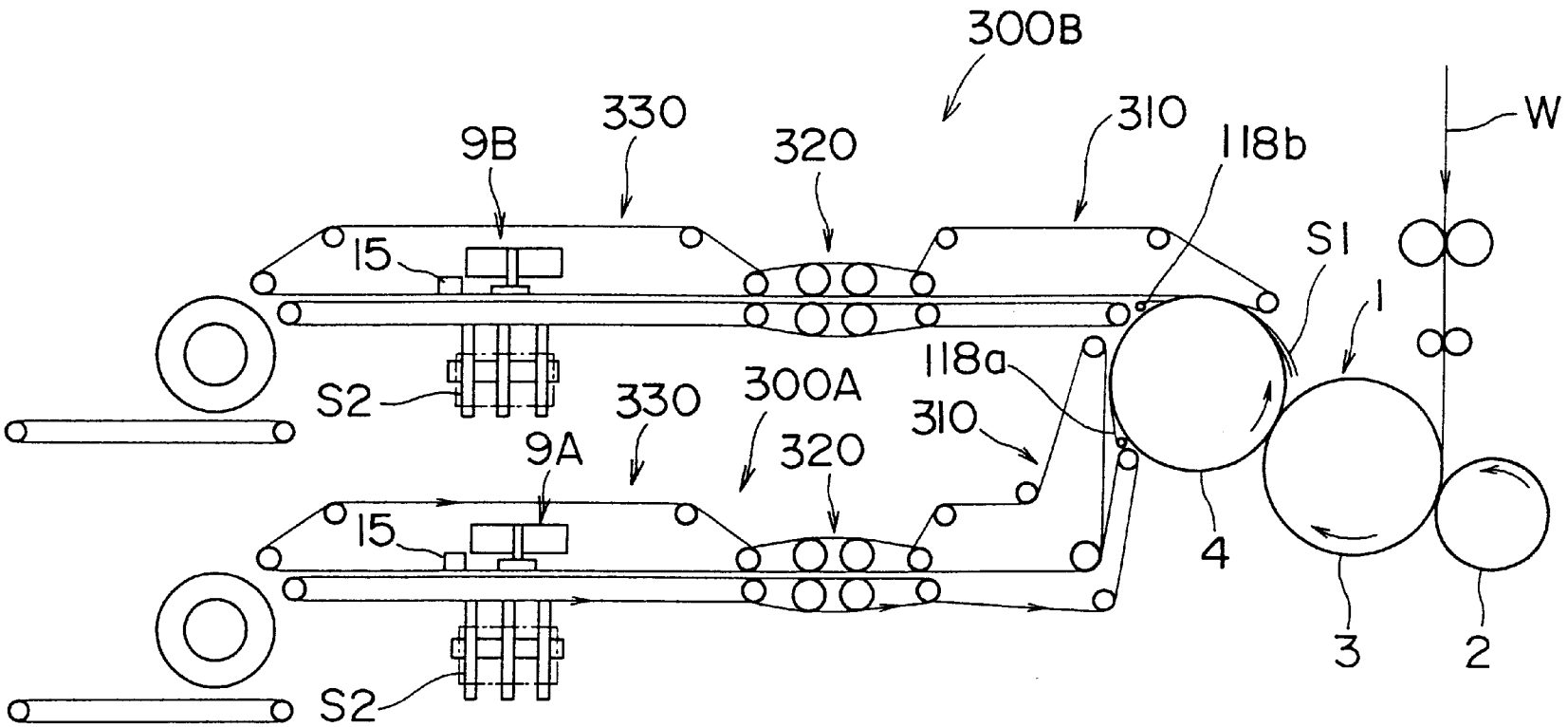
FIG. 9 is a diagram showing the schematic layout in a folding machine according to a third embodiment of the present invention.

FIG. 9 is a diagram showing the layout in a folding machine according to this embodiment. In the first embodiment, the signature conveying unit is applied to the folding machine incorporating the speed-reduction cylinder 5 and the delivery cylinder 6. In this embodiment, the signature conveying unit is applied to a usual commercial offset rotary press having three cylinders without the speed-reduction cylinder 5 and the delivery cylinder 6.

The signature conveying units 300A and 300B, as shown in FIG. 9, incorporate high-speed conveying means 310, a speed-change conveying means 320 and a low-speed conveying means 330 disposed in this sequential order in the downstream direction. The two high-speed conveying means 310 alternately receive the signatures S1 formed in the parallel folding portion 1 and discharged from the gripping cylinder 4 through paper separating guides 118*a* and 118*b* which are alternately and vertically moved to sort the signatures S1. Then, the high-speed conveying means 310 convey the signatures S1 at the same peripheral speed as that of the gripping cylinder 4.

The speed-change conveying means 320 receives the signature S1 conveyed from the high-speed conveying means 310 to deliver the signature S1 such that the conveyance speed is gradually reduced. The low-speed conveying means 330 conveys the signatures S1 to the chopper-folding units 9A and 9B at a low speed. Swinging mechanisms which is vertically swung in synchronization with the receipt and delivery timing of signatures S1 are disposed across the speed-change conveying means 320.

The detailed structures of the foregoing means are the same as those according to the first embodiment or the second embodiment.

This embodiment incorporates one set of the speed-change conveying means 320 provided for the upper and lower conveying passages, respectively. Thus, the speed is changed by one step. A plurality of sets of the speed-change conveying means 320 may be provided to realize a multiple speed change.

When the operation of the rotary press has been started, the continuous paper W is cut to have a predetermined size at a position between the serration cylinder 2 and the folding cylinder 3 in the parallel folding portion 1. The folded-line portion of the signature S1 folded into two In parallel with the cutting line at the position between the folding cylinder 3 and the gripping cylinder 4 is gripped by the gripping unit. Thus, the signature S1 is conveyed along the outer surface of the gripping cylinder 4. The gripping cylinder 4 is furthermore rotated so that the signature S1 is released from the gripping unit. Then, the signatures S1 are alternately separated from the gripping cylinder 4 by the upper and lower paper separating guides 118*b* and 118*a*.

The signatures S1 alternately separated by the paper separating guides 118*a* and 118*b* are held between the upper conveying belts 13*a* and 14 and the lower conveying belt 13*b* of the high-speed conveying means 310 formed continuously from the signature receiving portions. Thus, the signatures S1 are conveyed to the following speed-change conveying means 320 at the same peripheral speed as that of the gripping cylinder 4.

The operations and effects of the units following the speed-change conveying means are the same as those according to the first embodiment or the second embodiment.

The folding machine according to this embodiment incorporates the signature conveying unit having the high-speed conveying means 310 arranged to perform conveyance at the same peripheral speed as that of the gripping cylinder 4; the low-speed conveying means 330 for conveying the signatures S1 to the chopper-folding units 9A and 9B at the low speed; and the speed-change conveying means 320 for receiving the signatures S1 conveyed from the high-speed conveying means 310 to deliver the signatures S1 to the low-speed conveying means 330 such that the conveyance speed is gradually reduced. The speed of the signatures S1 is reduced in the conveyance process, and then alternately delivered to the two chopper-folding units 9A and 9B. Thus, the speed at which the signatures S1 are conveyed to the chopper-folding units can be reduced to enable a high-speed operation to be performed when the chopper-folding operation is performed.

The folding machine according to this embodiment and incorporating the three cylinders consisting of the serration cylinder 2, the folding cylinder 3 and the gripping cylinder 4 enables the same performance to be realized as that obtainable from the conventional five-cylinder folding machine further incorporating the speed-reduction cylinder 5 and the delivery cylinder 6. Moreover, the simple structure of the folding machine according to this embodiment facilitates the maintenance and inspection operations of the machine.

In this embodiment, the speed of the speed-change conveying means provided for each of the upper and lower conveying passages is reduced by one step. When a plurality of sets of the speed-change conveying means are provided to realize multiple speed change, a folding machine having the same performance as that of the first embodiment or the second embodiment can be realized.

A fourth embodiment of the present invention will now be described.

Figure 10:
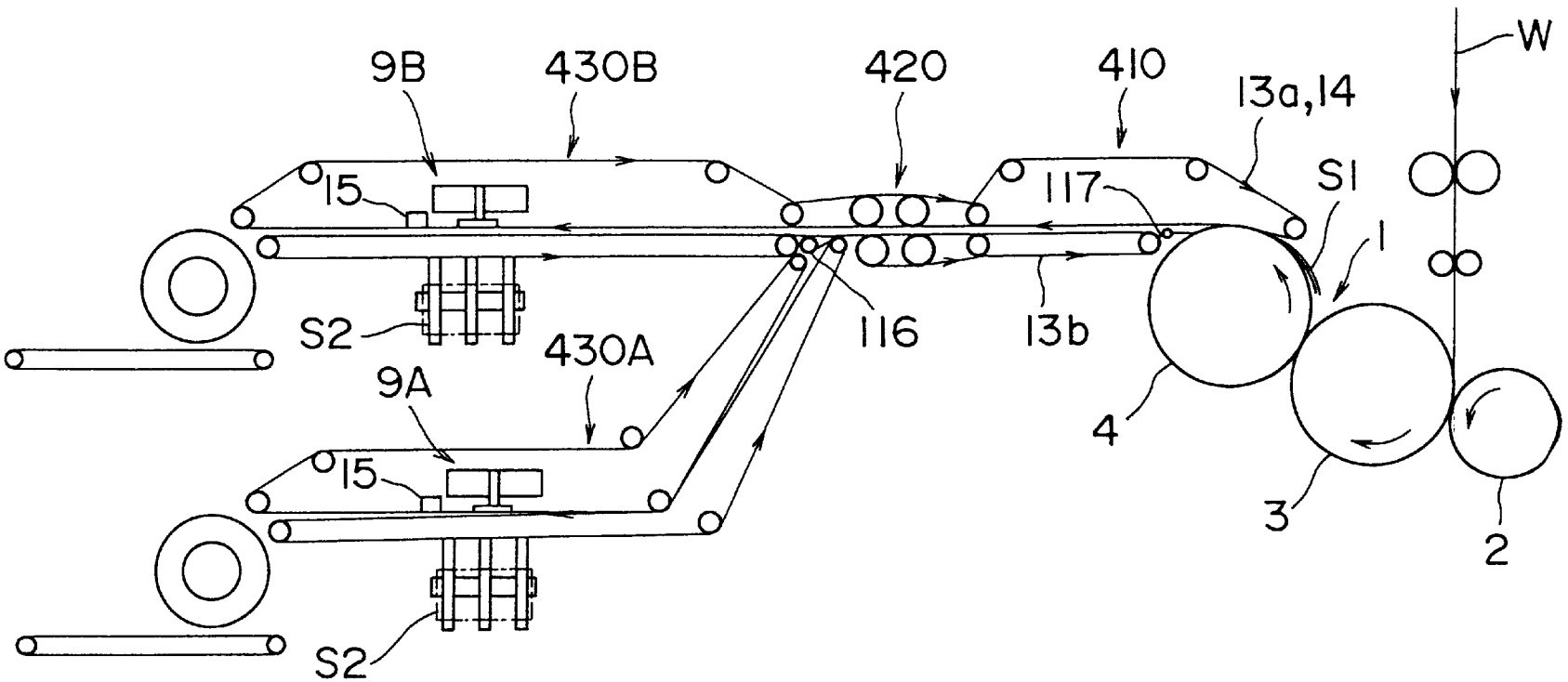
FIG. 10 is a diagram showing the schematic layout in a folding machine according to a fourth embodiment of the present invention.
Figure 11:
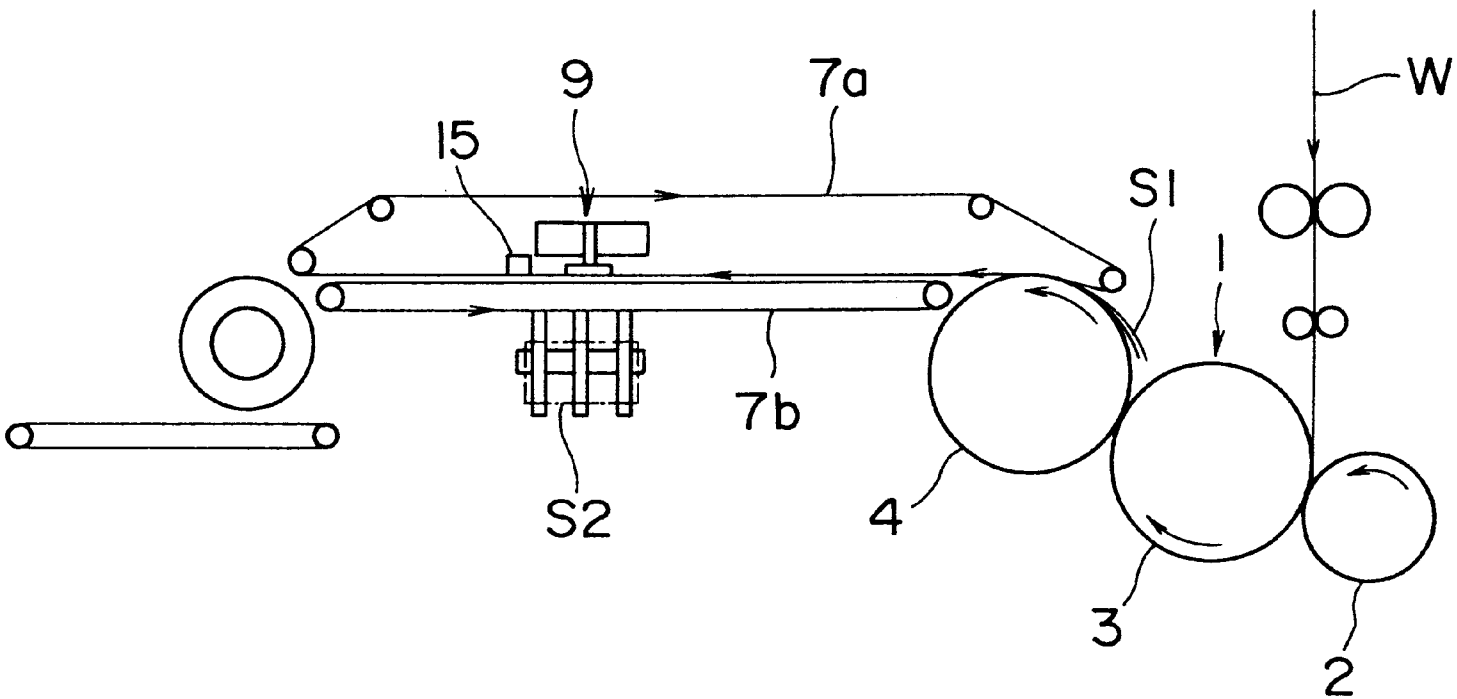
FIG.11 (RELATED ART)
FIG. 11 is a diagram showing the schematic layout in a conventional folding machine.
Figure 12:
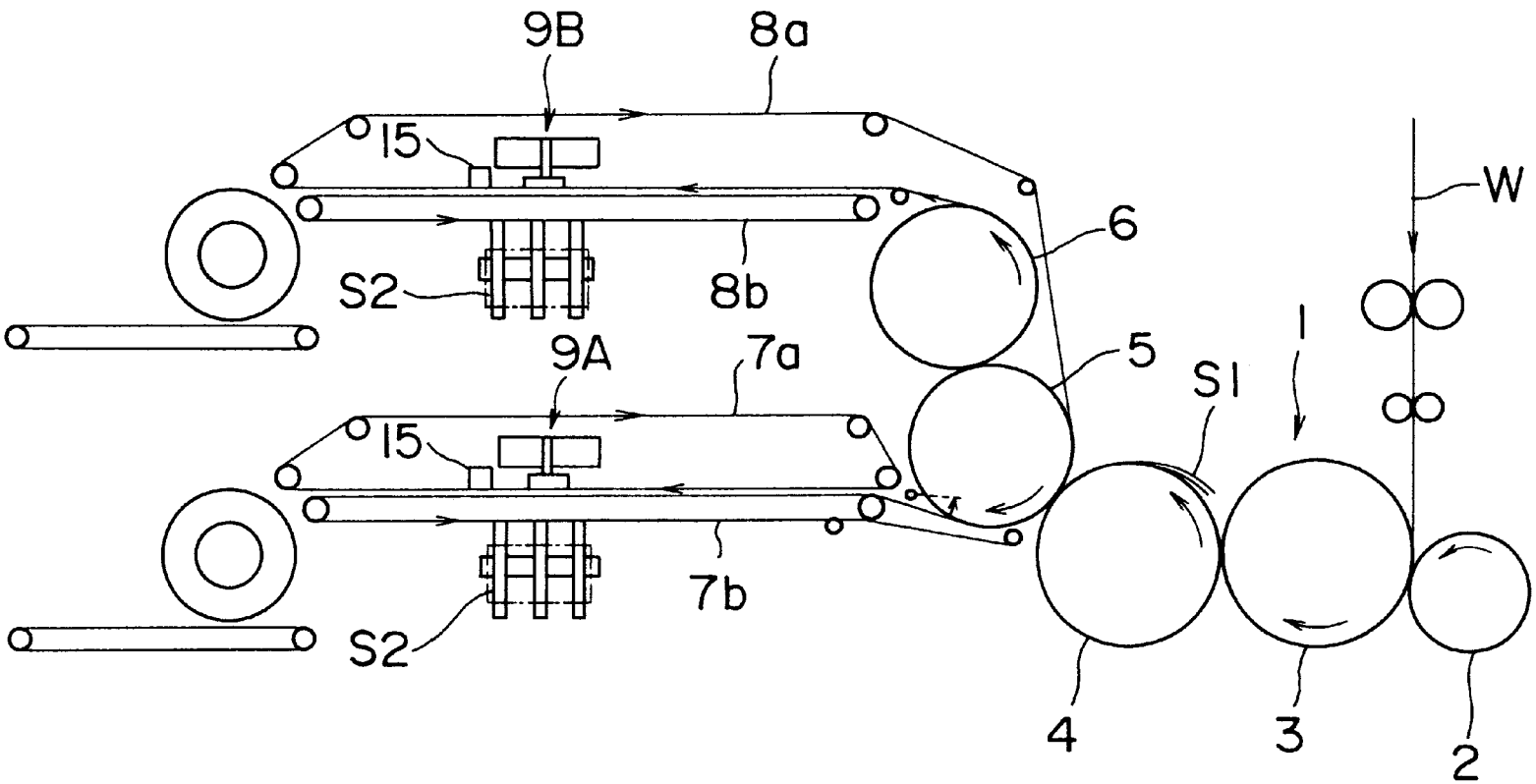
FIG. 12 (RELATED ART)
FIG. 12 is a diagram showing the schematic layout in another conventional folding machine.

FIG. 10 is a diagram showing the schematic layout in a folding machine.

The third embodiment has the structure that the two high-speed conveying means are directly connected to the gripping cylinder 4. Moreover, two paper separating guides 118*a* and 118*b* arranged to alternately and vertically move to sort the signatures S1 are provided for the connection portions. On the other hand, this embodiment incorporates a signature conveying unit having a high-speed conveying means 410, a speed-change conveying means 420 and two low-speed conveying means 430A and 430B. Moreover, the signature conveying unit according to this embodiment incorporates a passage sorting means 116.

The one high-speed conveying means 410 receives the signature S1 separated by one stationary paper-separating guide 117 to convey the signature S1 at the same peripheral speed as that of the gripping cylinder 4.

The one speed-change conveying means 420 receives the signatures S1 conveyed from the high-speed conveying means 410 to deliver the signatures S1 to the low-speed conveying means 430A and 430B such that the conveyance speed is gradually reduced.

The two low-speed conveying means 430A and 430B convey the signatures S1 to the chopper-folding units 9A and 9B at a low speed.

The passage sorting means 116 is disposed at the end portion of the speed-change conveying means 420 to alternately sort the signatures S1 to the two low-speed conveying means 430A and 430B. The passage sorting means 116 has a spit-shape guide plate arranged to vertically be swung. The swinging mechanism is a known technique for a skilled person in this industry. Therefore, the mechanism is omitted from description.

The detailed structures of the other means are the same as those according to the first embodiment or the second embodiment.

When the operation of the rotary press has been started, the continuous paper W is cut to have a predetermined size at the position between the serration cylinder 2 and the folding cylinder 3 in the parallel folding portion 1. The folded-line portion of the signature S1 cut into two in parallel with the cutting line at the position between the folding cylinder 3 and the gripping cylinder 4 is gripped by the gripping unit of the gripping cylinder 4 so as to be conveyed along the outer surface of the gripping cylinder 4. The gripping cylinder 4 is furthermore rotated so that the signature S1 is released from the gripping unit. Then, the signature S1 is separated from the gripping cylinder 4 by the stationary paper-separating guide 117.

Then, the signature S1 is held between the upper conveying belts 13*a* and 14 and the lower conveying belt 13*b* of the high-speed conveying means 410 connected to the signature discharge position of the gripping cylinder 4 so as to be conveyed to the speed-change conveying means 420 at the same peripheral speed as that of the gripping cylinder 4.

The signatures S1 moved to the speed-change conveying means 420 are conveyed to the following low-speed conveying means 430A and 430B such that the conveyance speed is gradually reduced owning to the same action according to the first embodiment or the second embodiment. The signatures S1 conveyed to the end portion of the speed-change conveying means 420 are alternately sorted to each passage by the guide plate of the passage sorting means 116. Then, the signatures S1 are held by the upper and lower conveying belts so as to be delivered to the chopper-folding units 9A and 9B at a low speed.

The other operations and effects are the same as those of the third embodiment. Since only one speed-change conveying means is required, an effect can be obtained in that the structure of the apparatus can be simplified.

Although the invention has been described in its preferred form and structure, it is understood that the present disclosure of the preferred form can be changed in the details of construction and in the combination and arrangement of parts without departing from the spirit and the scope of the invention.

The folding machine incorporating the signature conveying unit according to the present invention reduces the conveyance speed of the signature in the speed-reduction portion thereof, and then the conveyance speed is furthermore reduced by the speed-change conveying means. Therefore, repulsion which is produced when the signature is brought into contact with the stopper of the chopper-folding unit can significantly be reduced. Thus, the chopper-folding accuracy can furthermore be improved and stabilized even in a high-speed operation.

Since the speed-reduction cylinder and the delivery cylinder are omitted and a paper-separating guide is provided in place of the omitted cylinders, the structure of the machine can be simplified. Thus, maintenance and inspection of the machine can easily be performed.

Since structure according to the present invention incorporates the one high-speed conveying means and the two low-speed conveying means, the structure of the apparatus can be simplified.

The entire disclosure of Japanese Patent Application No. 10-46750 filed on Feb. 27, 1998 including specification, claims, drawings and summary are incorporated herein by reference in its entirely.

And the entire disclosure of Japanese Patent Application No. 10-259910 filed on Sep. 14, 1998 including specification, claims, drawings and summary are incorporated herein by reference in its entirely.

What is claimed is:

1. A signature-conveying apparatus for a folding machine comprising:

a high-speed conveyor arranged to receive signatures from a speed-reduction portion of the folding machine and operable to convey the signatures at the same peripheral speed as that of said speed-reduction portion;

a low-speed conveyor arranged to receive the signatures and operable to convey the signatures at a low speed; and a speed-change conveyor incorporating a plurality of speed-change drive rollers and a speed-change conveyor belt driven by the speed-change drive rollers for receiving the signatures conveyed from said high-speed conveyor and forcibly changing the speed so as to deliver the signatures to said low-speed conveyor such that the speed is gradually reduced, said speed-change conveyor belt having an inlet and arranged to receive signatures from the high-speed conveyor and an outlet end arranged to feed signatures to the low-speed conveyor, wherein the speed-change drive rollers are accelerated synchronously with a signature being delivered from the high-speed conveyor to the inlet end of the speed-change conveyor belt such that the inlet end of said speed-change conveyor belt travels at substantially the same speed as the high-speed conveyor when receiving a signature therefrom, and the speed-change rollers then gradually decelerate while transporting the signature such that by the time the signature reaches the outlet end of the speed-change conveyor belt the signature is discharged from the outlet end of said speed-change conveyor to said low-speed conveyor at substantially the same speed as that of the low-speed conveyor.

2. A signature-conveying apparatus for a folding machine according to claim 1, wherein the speed-change conveyor further comprises a rotative pressing roller.

3. A signature-conveying apparatus for a folding machine according to claim 2, wherein each of said high-speed conveyor, said speed-change conveyor and said low-speed conveyor incorporates upper and lower conveying belts arranged to hold the signatures therebetween and belt rollers around which the belts are arranged and which are rotated, and finder comprising a drive system for the speed-change drive rollers of said speed-change conveyor, the drive system including an acceleration/deceleration drive mechanism structured to be capable of changing the speed between a conveyance speed of said high-speed conveyor and a conveyance speed of said low-speed conveyor.

4. A signature-conveying apparatus for a folding machine according to claim 3, wherein swinging mechanisms for causing an end of said upper conveying belt to float in synchronization with timing at which the signature is introduced into and discharged from said speed-change conveyor are disposed at inlet and outlet ends of said speed-change conveyor.

5. A signature-conveying apparatus for a folding machine according to claim 1, wherein each of said high-speed conveyor, said speed-change conveyor and said low-speed conveyor incorporates upper and lower conveying belts arranged to hold the signatures therebetween and belt rollers around which the belts are arranged and which are rotated, and further comprising a drive system for the speed-change drive rollers of said speed-change conveyor, the drive system including an acceleration/deceleration drive mechanism structured to be capable of changing the speed between a conveyance speed of said high-speed conveyor and a conveyance speed of said low-speed conveyor.

6. A signature-conveying apparatus for a folding machine according to claim 5, wherein swinging mechanisms for causing an end of said upper conveying belt to float in synchronization with timing at which the signature is introduced into and discharged from said speed-change conveyor are disposed at inlet and outlet ends of said speed-change conveyor.

7. A signature-conveying apparatus according to claim 1, wherein the high-speed conveyor includes an upper belt looped about a plurality of rollers including at least one outlet-end roller located at an outlet end of the high-speed conveyor, the speed-change conveyor includes an upper belt looped about a plurality of rollers including at least one inlet-end roller located at an inlet end of the speed-change conveyor, and wherein the high-speed conveyor and speed-change conveyor share a common shaft on which the outlet-end roller and inlet-end roller are rotatably mounted.

8. A signature-conveying apparatus according to claim 7, wherein the high-speed conveyor and speed-change conveyor each include a lower belt arranged proximate the respective upper belt such that signatures are held between the upper and lower belts, and wherein the common shaft is movably mounted so as to be movable away from the lower belt of the speed-change conveyor to cause the upper belt of the speed-change conveyor to float above the lower belt.

9. A signature-conveying apparatus for a folding machine for conveying signatures formed in a parallel folding portion of said folding machine and discharged from a gripping cylinder, said signature-conveying apparatus for a folding machine comprising:

two sorting devices arranged to receive signatures conveyed along the outer surface of said gripping cylinder and operable to direct the signatures alternately along one or another passage;

two high-speed conveyors respectively arranged to receive signatures sorted by said sorting devices and operable to convey said signatures at the same peripheral speed as that of said gripping cylinder;

two low-speed conveyors arranged to receive the signatures and operable to convey the signatures at a low speed; and two speed-change conveyors each incorporating a plurality of speed-change drive rollers and a speed-change conveyor belt driven by the speed-change drive rollers for receiving the signatures conveyed from said high-speed conveyors and forcibly changing the speed so as to deliver the signatures to said low-speed conveyors such that the speed is gradually reduced, said speed-change conveyors each having an inlet end arranged to receive signatures from a respective one of the high-speed conveyors and an outlet end arranged to feed signatures to a respective one of the low-speed conveyors, wherein the speed-change drive rollers of each speed-change conveyor are accelerated synchronously with a signature being delivered from the respective high-speed conveyor to the inlet end of the speed-change conveyor belt such that the inlet end of each speed-change conveyor belt travels at substantially the same speed as the high-speed conveyor when receiving a signature therefrom, and the speed-change rollers then gradually decelerate while transporting the signature such that by the time the signature reaches the outlet end of the speed-change conveyor belt the signature is discharged from the outlet end of each speed-change conveyor to the respective low-speed conveyor at substantially the same speed as that of the low-speed conveyor.

10. A signature-conveying apparatus according to claim 9, wherein each of the speed-change conveyors further includes a rotative pressing roller.

11. A signature-conveying apparatus for a folding machine according to claim 10, wherein each of said high-speed conveyors, said speed-change conveyors and said low-speed conveyors incorporates upper and lower conveying belts arranged to hold the signatures therebetween and belt rollers around which the belts are arranged and which are rotated, and further comprising a drive system for the speed-change drive rollers of said speed-change conveyors, the drive system including an acceleration/deceleration drive mechanism structured to be capable of changing the speed between a conveyance speed of said high-speed conveyors and a conveyance speed of said low-speed conveyors.

12. A signature-conveying apparatus for a folding machine according to claim 11, wherein swinging mechanisms for causing an end of said upper conveying belt to float in synchronization with timing at which the signature is introduced into and discharged from each said speed-change conveyor are disposed at inlet and outlet ends of each said speed-change conveyor.

13. A signature-conveying apparatus for a folding machine according to claim 9, wherein each of said high-speed conveyors, said speed-change conveyors and said low-speed conveyors incorporates upper and lower conveying belts arranged to hold the signatures therebetween and belt rollers around which the belts are arranged and which are rotated, and further comprising a drive system for the speed-change drive rollers of said speed-change conveyors, the drive system including an acceleration/deceleration drive mechanism structured to be capable of changing the speed between a conveyance speed of said high-speed conveyors and a conveyance speed of said low-speed conveyors.

14. A signature-conveying apparatus for a folding machine according to claim 13, wherein swinging mechanisms for causing an end of said upper conveying belt to float in synchronization with timing at which the signature is introduced into and discharged from each said speed-change conveyor are disposed at inlet and outlet ends of each said speed-change conveyor.

15. A signature-conveying apparatus for a folding machine for conveying signatures formed in a parallel folding portion of said folding machine and discharged from a gripping cylinder, said signature-conveying apparatus for a folding machine comprising:

one high-speed conveyor arranged to receive signatures discharged from said gripping cylinder and operable to convey said signatures at the same peripheral speed as that of said gripping cylinder;

two low-speed conveyors arranged to receive the signatures and operable to convey the signatures at a low speed;

one speed-change conveyor incorporating a plurality of speed-change drive rollers and a speed-change conveyor belt driven by the speed-change drive rollers for receiving the signatures conveyed from said high-speed conveyor and forcibly changing the speed so as to deliver the signatures to said low-speed conveyors such that the speed is gradually reduced, said speed-change conveyor belt having an inlet end arranged to receive signatures from the high-speed conveyor and an outlet end arranged to feed signatures to the low-speed conveyor, wherein the speed-change drive rollers are accelerated synchronously with a signature being delivered from the high-speed conveyor to the inlet end of the speed-change conveyor belt such that the inlet end of said speed-change conveyor belt travels at substantially the same speed as the high-speed conveyor when receiving a signature therefrom, and the speed-change rollers then gradually decelerate while transporting the signature such that by the time the signature reaches the outlet end of the speed-change conveyor belt the signature is discharged from the outlet end of said speed-change conveyor to said low-speed conveyor at substantially the same speed as that of the low-speed conveyor; and a shorter for alternately sorting the signatures to the two low-speed conveyors, the sorter being disposed at an end of said speed-change conveyor.

16. A signature-conveying apparatus for a folding machine according to claim 15, wherein the speed-change conveyor further includes a rotative pressing roller.

17. A signature-conveying apparatus for a folding machine according to claim 16, wherein each of said high-speed conveyor, said speed-change conveyor and said low-speed conveyors incorporates upper and lower conveying belts arranged to hold the signatures therebetween and belt rollers around which the belts are arranged and which are rotated, and further comprising a drive system for the speed-change drive rollers of said speed-change conveyor, the drive system including an acceleration/deceleration drive mechanism structured to be capable of changing the speed between a conveyance speed of said high-speed conveyor and a conveyance speed of said low-speed conveyors.

18. A signature-conveying apparatus for a folding machine according to claim 17, wherein swinging mechanisms for causing an end of said upper conveying belt to float in synchronization with timing at which the signature is introduced into and discharged from said speed-change conveyor are disposed at inlet and outlet ends of said speed-change conveyor.

19. A signature-conveying apparatus for a folding machine according to claim 15, wherein each of said high-speed conveyor, said speed-change conveyor and said low-speed conveyors incorporates upper and lower conveying belts arranged to hold the signatures therebetween and belt rollers around which the belts are arranged and which are rotated, and further comprising a drive system for the speed-change drive rollers of said speed-change conveyor, the drive system including an acceleration/deceleration drive mechanism structured to be capable of changing the speed between a conveyance speed of said high-speed conveyor and a conveyance speed of said low-speed conveyors.

20. A signature-conveying apparatus for a folding machine according to claim 19, wherein swinging mechanisms for causing an end of said upper conveying belt to float in synchronization with timing at which the signature is introduced into and discharged from said speed-change conveyor are disposed at inlet and outlet ends of said speed-change conveyor.

* * * * *

UNITED STATES PATENT AND TRADEMARK OFFICE

CERTIFICATE OF CORRECTION

PATENT NO. : 6,237,912 B1
DATED : May 29, 2001
INVENTOR(S) : Motooka et al.

It is certified that error appears in the above-identified patent and that said Letters Patent is hereby corrected as shown below:

Column 15,
Line 63, "and" should read -- end --.

Column 16,
Line 22, "finder" should read -- further --.

Column 18,
Line 59, "shorter" should read -- sorter --.

Signed and Sealed this

Eighth Day of January, 2002

*Attest:*

*Attesting Officer*

JAMES E. ROGAN
*Director of the United States Patent and Trademark Office*